US010097918B2

(12) United States Patent
Spoettl et al.

(10) Patent No.: US 10,097,918 B2
(45) Date of Patent: Oct. 9, 2018

(54) CHIP ARRANGEMENT AND A METHOD FOR MANUFACTURING THE SAME

(71) Applicant: Infineon Technologies AG, Neubiberg (DE)

(72) Inventors: Thomas Spoettl, Mintraching (DE); Horst Theuss, Wenzenbach (DE)

(73) Assignee: Infineon Technologies AG, Neubiberg (DE)

( * ) Notice: Subject to any disclaimer, the term of this patent is extended or adjusted under 35 U.S.C. 154(b) by 138 days.

(21) Appl. No.: 13/747,496

(22) Filed: Jan. 23, 2013

(65) Prior Publication Data

US 2014/0205128 A1 Jul. 24, 2014

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 3/00*** | (2006.01) |
| ***H04R 31/00*** | (2006.01) |
| *H04R 19/00* | (2006.01) |

(52) U.S. Cl.

CPC ..... *H04R 3/00* (2013.01); *H04R 31/00* (2013.01); *H04R 19/005* (2013.01)

(58) Field of Classification Search

CPC . H04R 1/08; H04R 1/083; H04R 9/08; H04R 11/04; H04R 17/02; H04R 21/02

USPC ..... 381/369

See application file for complete search history.

(56) References Cited

U.S. PATENT DOCUMENTS

| | | | | |
|---|---|---|---|---|
| 6,190,943 | B1 * | 2/2001 | Lee | H01L 23/3114 257/E23.039 |
| 2003/0180508 | A1 * | 9/2003 | McArdle et al. | 428/195.1 |
| 2005/0189635 | A1 * | 9/2005 | Humpston et al. | 257/678 |
| 2008/0123891 | A1 | 5/2008 | Kato et al. | |
| 2008/0130935 | A1 * | 6/2008 | Sato | H04R 1/2884 381/361 |
| 2008/0203560 | A1 | 8/2008 | Suzuki | |
| 2008/0247585 | A1 * | 10/2008 | Leidl | B81B 7/0061 381/360 |
| 2008/0279407 | A1 * | 11/2008 | Pahl | B81B 7/0064 381/355 |
| 2010/0176467 | A1 | 7/2010 | Fukasawa et al. | |
| 2011/0222717 | A1 * | 9/2011 | Kuratani | H04R 19/005 381/355 |
| 2011/0241197 | A1 * | 10/2011 | Theuss | 257/693 |
| 2013/0070951 | A1 * | 3/2013 | Tanaka | H04R 1/38 381/361 |

FOREIGN PATENT DOCUMENTS

| | | | |
|---|---|---|---|
| CN | 1980492 | A | 6/2007 |
| CN | 101237720 | A | 8/2008 |
| CN | 201153325 | Y | 11/2008 |

* cited by examiner

*Primary Examiner* — Sean H Nguyen

(74) *Attorney, Agent, or Firm* — Viering, Jentschura & Partner mbB

(57) ABSTRACT

In various embodiments, a method for manufacturing a chip arrangement, the method including bonding a microphone chip to a first carrier, the microphone chip including a microphone structure, depositing adhesive material laterally disposed from the microphone structure, and arranging the microphone structure into a cavity of a second carrier such that the adhesive material fixes the microphone chip to the cavity of the second carrier.

24 Claims, 9 Drawing Sheets

CHIP ARRANGEMENT AND A METHOD FOR MANUFACTURING THE SAME

TECHNICAL FIELD

Various embodiments relate generally to chip arrangements and methods for manufacturing the same.

BACKGROUND

FIG. 1 is a schematic showing a perspective cross sectional view of a conventional silicon microphone 100. In some conventional silicon microphone micro-electromechanical system (MEMS) chips 100, the active areas includes a very thin membrane 102, typically having a thickness of a few hundred nanometers as well as a counter electrode 104 suspended over a through hole 106. The micro-electromechanical system (MEMS) chip 100 with the membrane 102 is etched from the backside. The counter electrode 104 is also typically very thin. Both the membrane 102 and the counter electrode 104 are partially metalized. Acoustic waves will impinge on the membrane 102. This will cause the membrane 102 to oscillate. The acoustic waves are detected by measuring the capacitance change due to the oscillation of the membrane 102. The performance of the microphone usually depends on the volume on the back side of the membrane, i.e. the side opposite the front side in which acoustic wave impinge on.

FIG. 2 is a diagram showing various components that may be present in a conventional silicon microphone 200. The silicon microphone includes a micro-electromechanical system (MEMS) chip 202 with a membrane 204. The MEMS chip 202 is mounted and wire bonded to a substrate 206. The silicon microphone 200 may also include an optional logic chip 208. The micro-electromechanical chip 202 and the optional logic chip 208 may be connected by electrical leads. The silicon microphone 200 also has a lid 210 to cover the micro-electromechanical chip 202 and the optional logic chip 208.

FIG. 3 is a schematic showing a side cross sectional view of another conventional silicon microphone 300. A micro-electromechanical system (MEMS) chip 302 is mounted on a substrate 304. An application specific integrated circuit (ASIC) chip 306 is also mounted onto the substrate 304. The ASIC chip 306 is wire bonded to the MEMS chip 302. The ASIC chip 306 is also wire bonded to the substrate 304. An electrically conductive lid 308 is used to cover the MEMS chip 302 and the ASIC chip 306. The lid 308 has an opening or hole 310 which allows the input or entry of sound such that acoustic waves is able to reach the MEMS chip 302. The volume below the MEMS chip 302 that is being removed by means of etching is the backside volume. The lid 308 may be used as a shielding from electromagnetic waves and therefore is electrically connected to the substrate 304. The ASIC chip 306 is usually covered with a polymer for reliability reasons (such as protecting exposed aluminum metallization form corrosion).

The manufacture of conventional silicon microphones typically involves numerous processing steps and/or require the use of complicated machines. It is also difficult to adjust the backside volume to optimize the performance of the silicon microphones as the backside volume is limited by the thickness of the wafer in which the MEMS chip is fabricated from.

SUMMARY

In various embodiments, a method for manufacturing a chip arrangement, the method including bonding a microphone chip to a first carrier, the microphone chip including a microphone structure, depositing adhesive material laterally disposed from the microphone structure, and arranging the microphone structure into a cavity of a second carrier such that the adhesive material fixes the microphone chip to the cavity of the second carrier.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIGS. 8A to 8E, shows a method to manufacture a chip arrangement according to various embodiments; wherein FIG. 8A is a schematic showing a cross-sectional side view of a module including a microphone chip and a further chip according to various embodiments before adhesive material is deposited; wherein FIG. 8B is a schematic showing a top planar view of a plurality of modules on a first carrier according to various embodiments before adhesive material is applied; wherein FIG. 8C is a schematic showing a cross-sectional side view of the module including a microphone chip and a further chip according to various embodiments shown in FIG. 8A after adhesive material is deposited; wherein FIG. 8D is a schematic showing a top planar view of the modules on the carrier according to various embodiments shown in FIG. 8B after adhesive material is applied; wherein FIG. 8E is a schematic showing a cross sectional side view of a first chip module and a second chip module according to various embodiments shown in FIG. 8C being arranged with a second carrier;

FIGS. 10A to 10C, shows a method to manufacture a chip arrangement according to various embodiments; wherein FIG. 10A is a schematic showing a cross-sectional side view of a plurality of modules on a carrier according to various embodiments; wherein FIG. 10B is a schematic showing a second carrier with a conductive metal on one side of the second carrier; and wherein FIG. 10C shows the first carrier and the second carrier being brought together and singulated to form a plurality of chip arrangements.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various aspects of this disclosure provide an improved chip arrangement and a method of manufacturing the same that is able to address at least partially some of the above-mentioned challenges.

Figure 1:
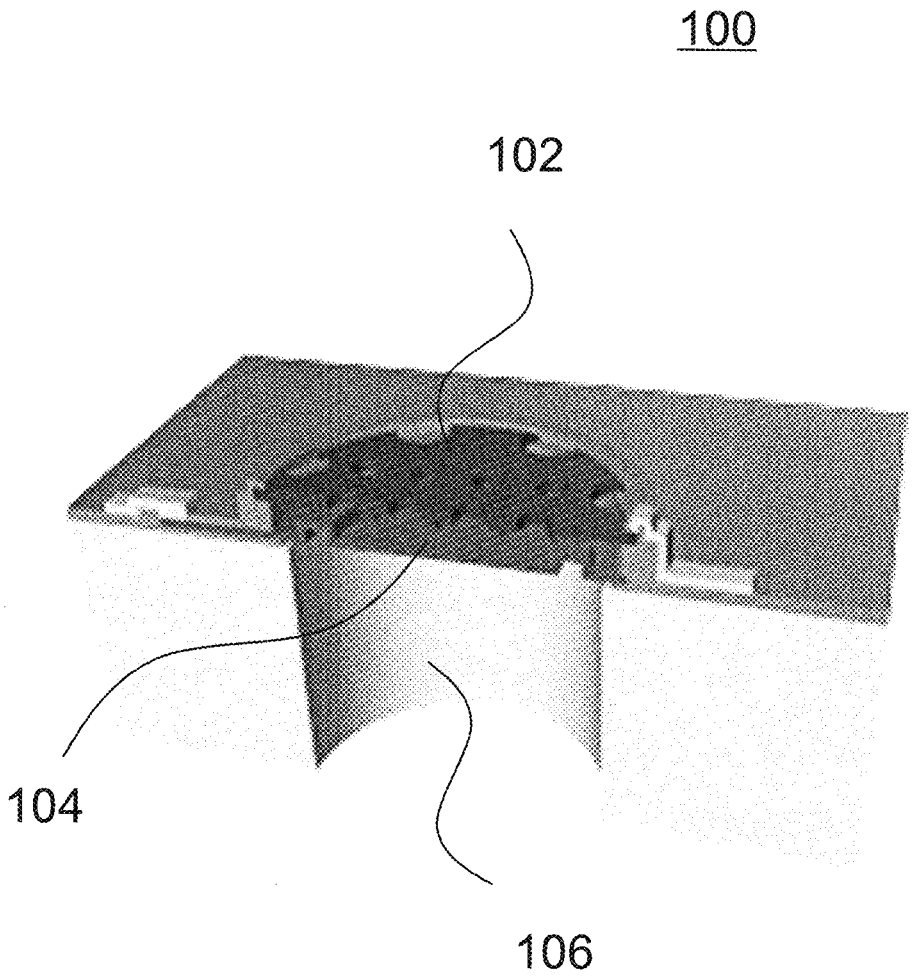
FIG. 1 shows a perspective cross sectional view of a conventional silicon microphone.
Figure 2:
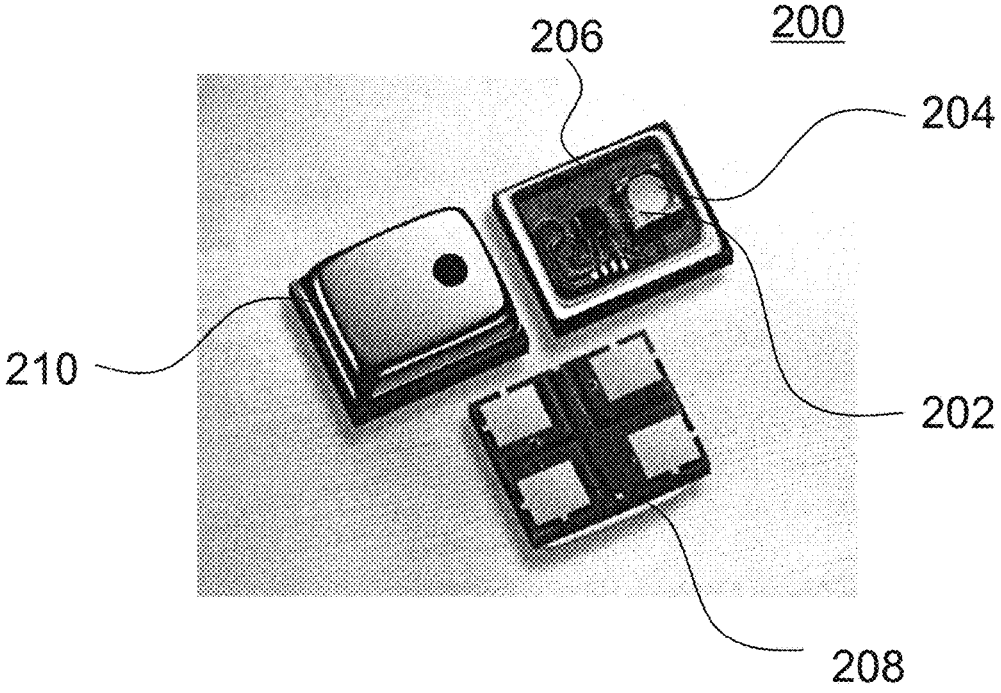
FIG. 2 is a diagram showing the various components that may be present in a conventional silicon microphone.
Figure 3:
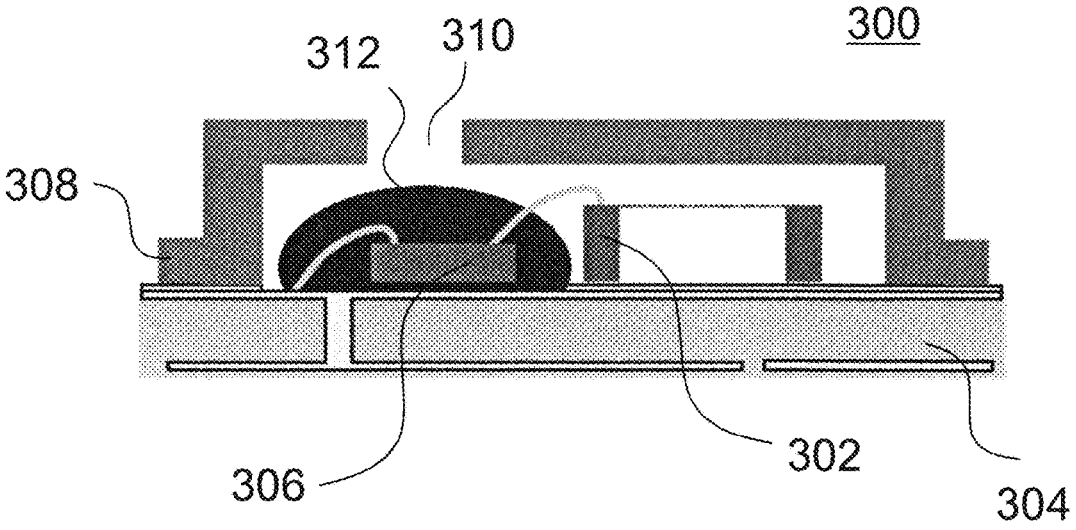
FIG. 3 shows a side cross sectional view of another conventional silicon microphone.
Figure 4:
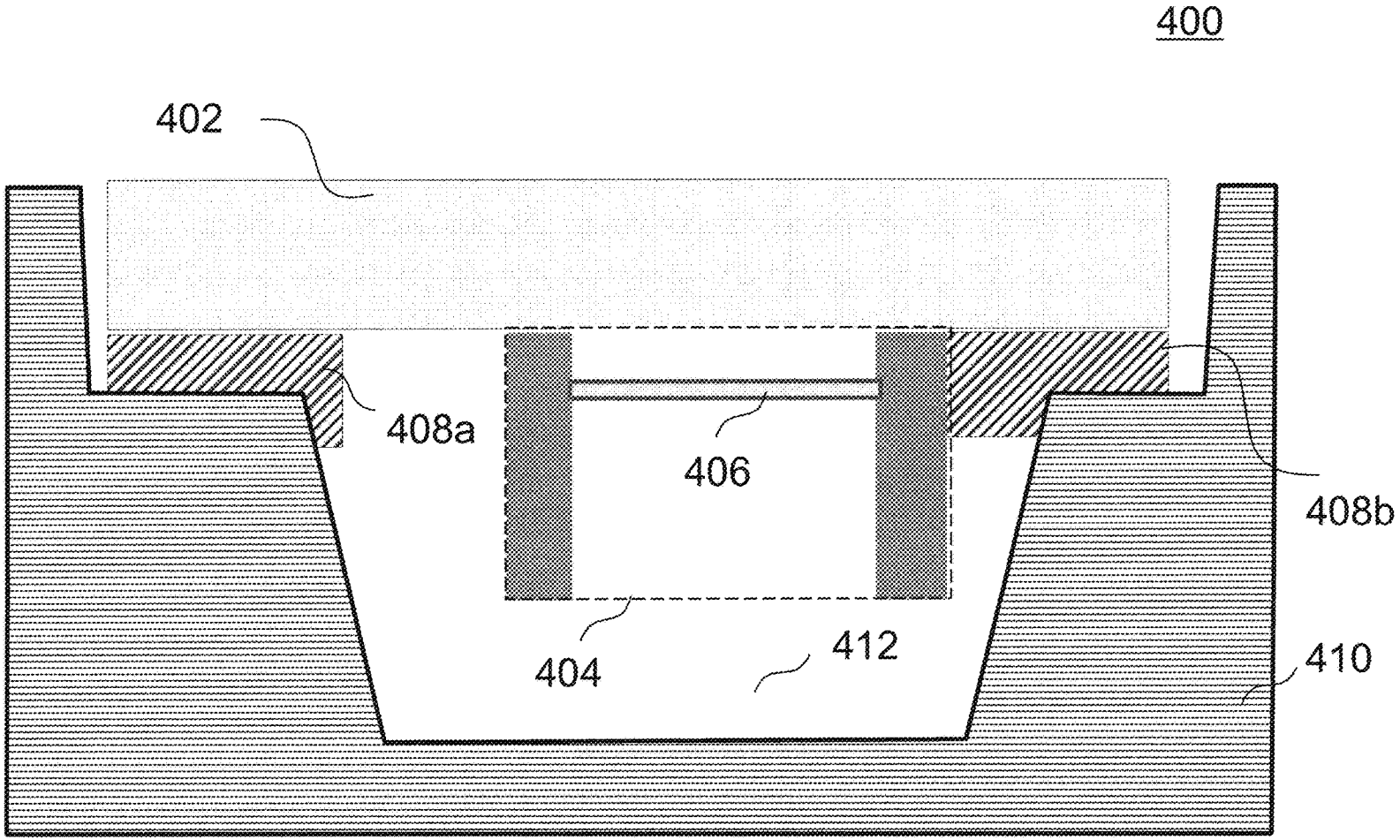
FIG. 4 shows a cross sectional view of a chip arrangement according to various embodiments.

FIG. 4 is a schematic showing a cross sectional view of a chip arrangement 400 according to various embodiments. In various embodiments, a chip arrangement 400 may include a first carrier 402, a microphone chip 404 bonded to the first carrier 402, the microphone chip 404 including a microphone structure 406. The chip arrangement 400 may further include adhesive material 408*a*, 408*b* laterally disposed from the microphone structure 406. The chip arrangement 400 may further include a second carrier 410 including a cavity 412, wherein the microphone structure 406 is arranged in the cavity 412 of the second carrier 410 such that the adhesive material 408 fixes the microphone chip 404 to the cavity 412 of the second carrier 410.

The adhesive material 408 may be provided by a double-sided adhesive tape, wherein e.g. both sides of the tape may be coated with hot melt material. In various embodiments, hot melt material may be understood as a material which may be adhesively activated at a predetermined high temperature, e.g. at a temperature in the range from about 70° C. to about 230° C., e.g. at a temperature in the range from about 140° C. to about 230° C. In various embodiments, the hot melt material may include or may consist of one or more of the following materials:

- Polyethylenetherephthalate (PET), which may have an activation temperature in the range from about 70° C. to about 160° C.);
- Nitrile rubber, which may have an activation temperature in the range from about 200° C. to about 220° C.;
- Nitrilic phenole, which may have an activation temperature in the range from about 200° C. to about 220° C.;
- phenolic resin;
- thermoplastic copolyamide;
- and the like.

In various embodiments, the hot melt process may include, first smoothly and softly pre-adhering the adhesive tape to the first carrier 402 at a temperature of about 100° C., followed by a pressing of the adhesive tape together with the first carrier 402 to the second carrier 410 at a temperature of about 200° C.

The first carrier 402 may be formed by any suitable material, such as e.g. PET (Polyethylenetherephthalate) (e.g. with sputtered metal shielding), adhesiveless metalized PI (Polyimide), or a laminate (polymer and glue and metal foil) or e.g. any other suitable metalized polymer.

The second carrier 410 may be formed by any suitable material, such as e.g. any suitable plastic material, such as e.g. PVC (polyvinylechloride), PC (poly carbonate), PET (Polyethylenetherephthalate), or ABS (alkyl benzene sulfonate).

In other words, the microphone chip 404 is attached to the first carrier 402. The first carrier 402 is attached to the second carrier 410 using the adhesive material 408*a*, 408*b* such that the microphone chip 404 is acoustically sealed within the cavity 412 of the second carrier 410.

The backside volume may be adjustable by adjusting the size of the cavity 412 of the second carrier 410. The backside volume may be no longer limited by the wafer in which the MEMS chip is fabricated from. In various embodiments, the cavity 412 may have a depth in the range from about 0.4 mm to about 2 mm, e.g. in the range from about 0.5 mm to about 1.5 mm, e.g. in the range from about 0.6 mm to about 1 mm, e.g. about 0.8 mm. Furthermore, the cavity 412 (i.e. the hollow space defined by the horizontal edges on which the adhesive material 408*a*, 408*b* is disposed, into which the microphone structure is projecting into) may have a length and/or a width (in case of a circular surface shape a diameter) in the range from about 1 mm to about 3 mm, e.g. in the range from about 1.2 mm to about 2 mm, e.g. in the range from about 1.3 mm to about 1.5 mm.

Figure 5:
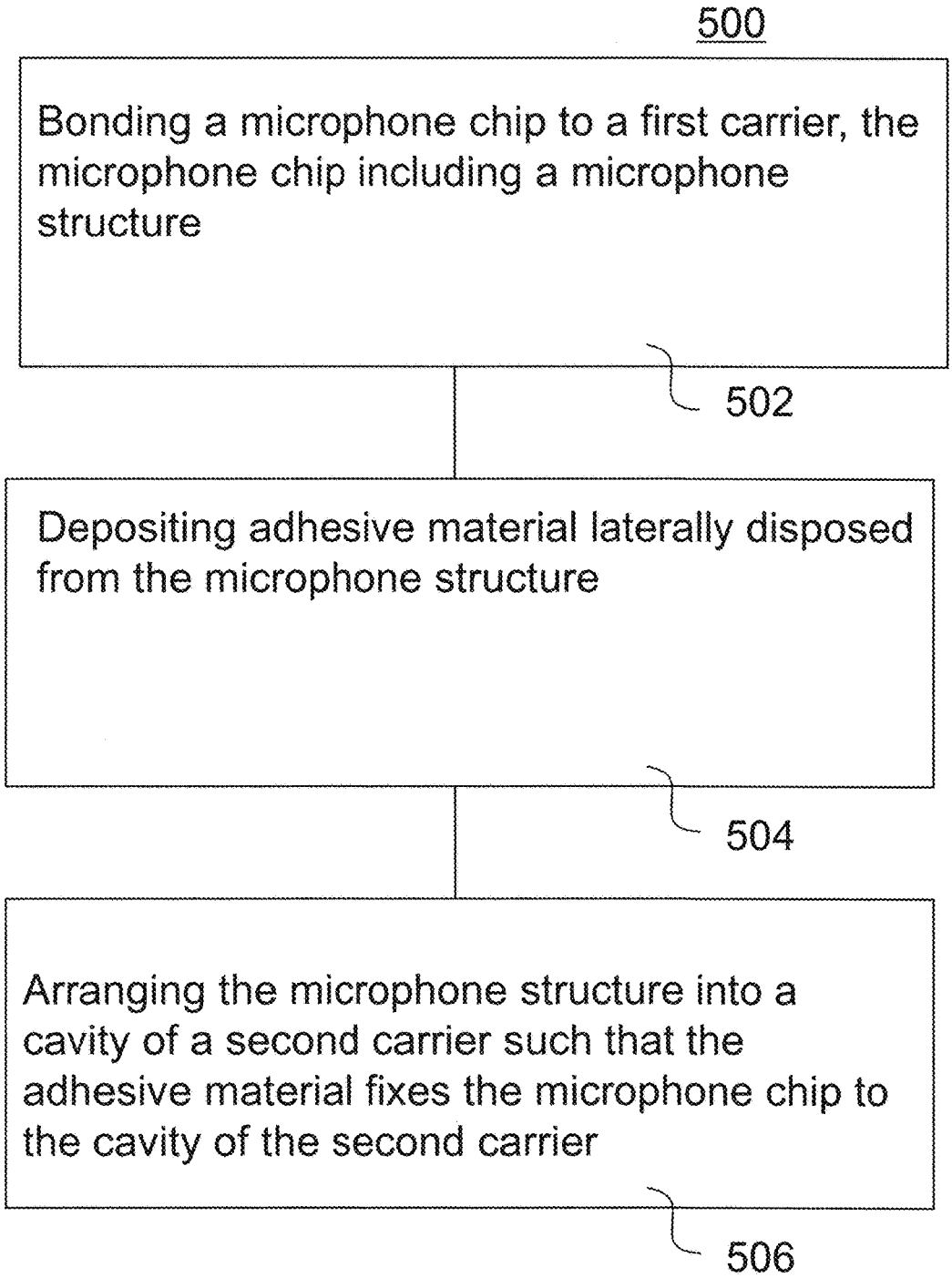
FIG. 5 shows a method to manufacture a chip arrangement according to various embodiments.

FIG. 5 is a schematic illustrating a method 500 to manufacture a chip arrangement according to various embodiments. According to various embodiments, a method 500 for manufacturing a chip arrangement may include bonding a microphone chip to a first carrier, the microphone chip including a microphone structure (in 502); depositing adhesive material laterally disposed from the microphone structure (in 504); and arranging the microphone structure into a cavity of a second carrier such that the adhesive material fixes the microphone chip to the cavity of the second carrier (in 506).

In other words, a microphone chip having a microchip structure may be joined to a first carrier. Adhesive material may be deposited laterally from the microchip structure. The first carrier may be attached to a second carrier using the adhesive material such that the microphone chip is acoustically sealed within a cavity of the second carrier.

Various embodiments may provide a simple and cost effective method to form a microphone.

In various embodiments, the microphone structure may be arranged into the cavity of the second carrier so that the adhesive forms an acoustic seal between the first carrier and the second carrier. In various embodiments, arranging the microphonestructure into the cavity of the second carrier may include pressing the first carrier into the cavity of the second carrier. In various embodiments, the pressing may be carried out using a pressure force in the range from about 50 N to about 150 N, at a temperature from about 150° C. to about 250° C.

In various embodiments, the microphone chip may be bonded to the first carrier via a flip chip bonding. In various embodiments, bonding the microphone chip to the first carrier may include a flip chip on substrate process. Flip chip bonding may refer to a process of interconnecting semiconductor chips with carriers. Flip chip technology may make it possible to increase the packing density of elements on a carrier and may allow for a more direct and stable electrical interconnection compared to wire bond technology.

In various embodiments, a plurality of microphone chips may be bonded to the first carrier. In other words, the method may further include bonding further microphone chips to the first carrier, each subsequent microphone chip including a microphone structure. The method may also further include depositing adhesive material laterally disposed from each microphone structure of a plurality of microphone structures. The method may further include arranging each microphone structure of the plurality of microphone structures into a cavity of a plurality of cavities of a second carrier such that the adhesive material fixes each microphone chip of the plurality of microphone chips to each cavity of the plurality of cavities of the second carrier. The method may also further include singulating the first carrier and the second carrier to form a plurality of chip arrangements. A plurality of chip arrangements may be manufactured simultaneously using a single process, possibly leading to lower manufacturing costs.

In various embodiments, the microphone structure may include at least one membrane configured to receive sound waves. In various embodiments, the at least one membrane may include at least one electrode. The microphone structure may further include at least one counter electrode. Each counter may be spaced apart from each membrane such that the counter electrode and the at least one electrode in the membrane forms a capacitive structure. When the membrane receives a sound wave, the membrane may deflect or oscillate, changing the distance between the counter electrode and the at least one electrode in the membrane. The capacitance of the capacitive structure may thus be varied. In this manner, the microphone structure may be able to detect the sound waves.

In various embodiments, the microphone chip includes a first electrical interconnect coupled to the counter electrode and a second electrical interconnect coupled to the at least one electrode in the membrane. The first and second electrical interconnects may be configured to be electrically coupled to the further chip or to electrical interconnects in the chip arrangement or to external electrical interconnects. The electrical interconnects may be configured to carry electrical signals out from the microphone chip. The electrical signals may be generated by the microphone chip due to deflection or oscillation of the membrane. In various embodiments, the electrical interconnects may be configured to carry electrical signals into the microphone chip. The electrical signals may be used for instance to control the stiffness of the membrane.

In various embodiments, a further chip bonded to the first carrier, wherein the further chip is electrically coupled to the microphone chip. In various embodiments, the further chip is electrically coupled to the microphone chip. The further chip may be electrically coupled to the microchip via the first carrier. This may provide a more robust and stable electrical interconnection compared to wire bond technology. Alternatively, in various embodiments, the further chip may be electrically coupled to the microphone chip via wire bonds. In various embodiments, the further chip may be electrically coupled to the microphone chip via the first carrier and via wire bonds.

In various embodiments, the further chip may be configured to process signals transmitted by the microphone chip. In other words, the further chip is configured to carry out signal processing of one or more signals received from the microphone chip. In various embodiments, the further chip may be configured to control the microphone chip, such as varying the sensitivity of the microphone chip. The further chip may include a logic chip or may include an application specific integrated circuit (ASIC) chip. In various embodiments, the further chip may be or include a hard wired logic chip and/or a programmable logic chip (such as e.g. a programmable processor, e.g. a programmable microprocessor).

In various embodiments, the first carrier may be a chip card. In various embodiments, the first carrier may have a width of about 35 mm. Bonding the microphone chip to the first carrier may be a chip card process. This may allow existing equipment for manufacturing chip cards to be used and may remove the need for dedicated equipment which may be expensive.

In various embodiments, the method for manufacturing a chip arrangement may further include melting the adhesive material. Melting the adhesive material may include heating the adhesive material from about 110° C. to about 130° C. or from about 100° C. to about 120° C. or from about 105° C. to about 115° C. In various embodiments, melting the adhesive material includes a lamination process. In various embodiments, melting the adhesive material includes a dispensing or a printing process.

In various embodiments, the adhesive material includes hot melting material. Hot melting material may also be referred to as hot melt adhesive. Hot melting material is a form of thermoplastic adhesive. Hot melting material may be configured to be melted by a heating element before applying or depositing. In other words, the method may include melting the hot melting material. The melted hot melting material may be applied or deposited using lamination or dispensing or printing. In other words, melting the hot melting material may include a lamination process or a dispensing process or a printing process. The hot melting material may be configured to solidify rapidly upon removal from the heating element, for instance in room temperatures of about 25° C. In various embodiments, the hot melting material may be configured to solidify in less than 5 minutes or less than 2 minutes or less than 1 minute or less than 30 seconds. In other words, depositing the hot melting material or adhesive material may include depositing the hot melting material or the adhesive material before solidification of the melted hot melting material or the melted adhesive material. Depositing the hot melting material or adhesive material may include depositing the hot melting material or the adhesive material within 5 minutes or within 2 minutes or within 1 minute or within 30 seconds upon removal from the heating element. The hot melting material may be deposited laterally disposed from the microphone structure. The hot melting material may be applied to or deposited on the first carrier, the hot melting material laterally disposed from the microphone structure. The first carrier and the second carrier may be brought together such that the microphone structure of the microphone chip, the microphone chip bonded to the first carrier, is in a cavity of the second carrier. The hot melting material or adhesive material applied to or deposited on the first carrier may be brought into (direct or physical) contact with the second carrier. On solidification of the hot melting material, the microphone chip may be fixed to the cavity of the second carrier. The adhesive material or hot melting material may be laterally disposed from the microphone structure.

Alternatively, the adhesive or hot melting material may be applied to the second carrier. The first carrier and the second carrier may be brought together such that the microphone structure of the microphone chip, the microphone chip bonded to the first carrier, is in a cavity of the second carrier. The hot melting material or adhesive material applied to or deposited on the second carrier may be brought into contact with the first carrier. On solidification of the hot melting material, the microphone chip may be fixed to the cavity of the second carrier. The adhesive material or hot melting material may be laterally disposed from the microphone structure.

Hot melting materials may provide several advantages over solvent-based adhesives. Hot melting materials may reduce or eliminate volatile organic compounds. The drying or curing step may be eliminated. Hot melt adhesives may have a long shelf life and usually may be disposed of without special precautions.

In various embodiments, the adhesive material is deposited after the microphone chip has been bonded to the first carrier. In various embodiments, the adhesive material includes a material selected from a group of materials consisting of: polyethylene terephthalate (PET), nitrile-rubber, and artificial caoutchouc. In various embodiments, the adhesive material may be disposed with a layer thickness in the range from about 30 μm to about 150 μm, e.g. in the range from about 50 μm to about 100 μm, e.g. in the range from about 70 μm to about 80 μm.

In various embodiments, the second carrier includes plastic material such as stamped plastic material or thermoformable plastic material.

In various embodiments, the microphone chip and/or the further chip may be joined (in other words fixed) to the first carrier using an adhesive. In various embodiments, the adhesive may be a non-conductive adhesive. The microphone chip may be joined (in other words fixed) to the first carrier by means of stud bumps on the microphone chip. In various embodiments, the further chip may be joined to the first carrier by means of stud bumps on the further chip. The microphone chip and/or the further chip may be joined to the first carrier by joining the stud bumps of the microphone chip and/or the further chip to the first carrier using the adhesive. In various embodiments, the microphone chip may be joined (in other words fixed) to the first carrier by means of thixotropic die attach material. This may protect the membrane during the manufacturing process. In various embodiments, a flow barrier may be provided, e.g. implemented by one or more projections (e.g. of a height of about at least 10 μm), e.g. made of a resist, e.g. photo resist, or a metal, which flow barrier may be provided as a flow stop for the adhesive of the stud bump.

Figure 6:
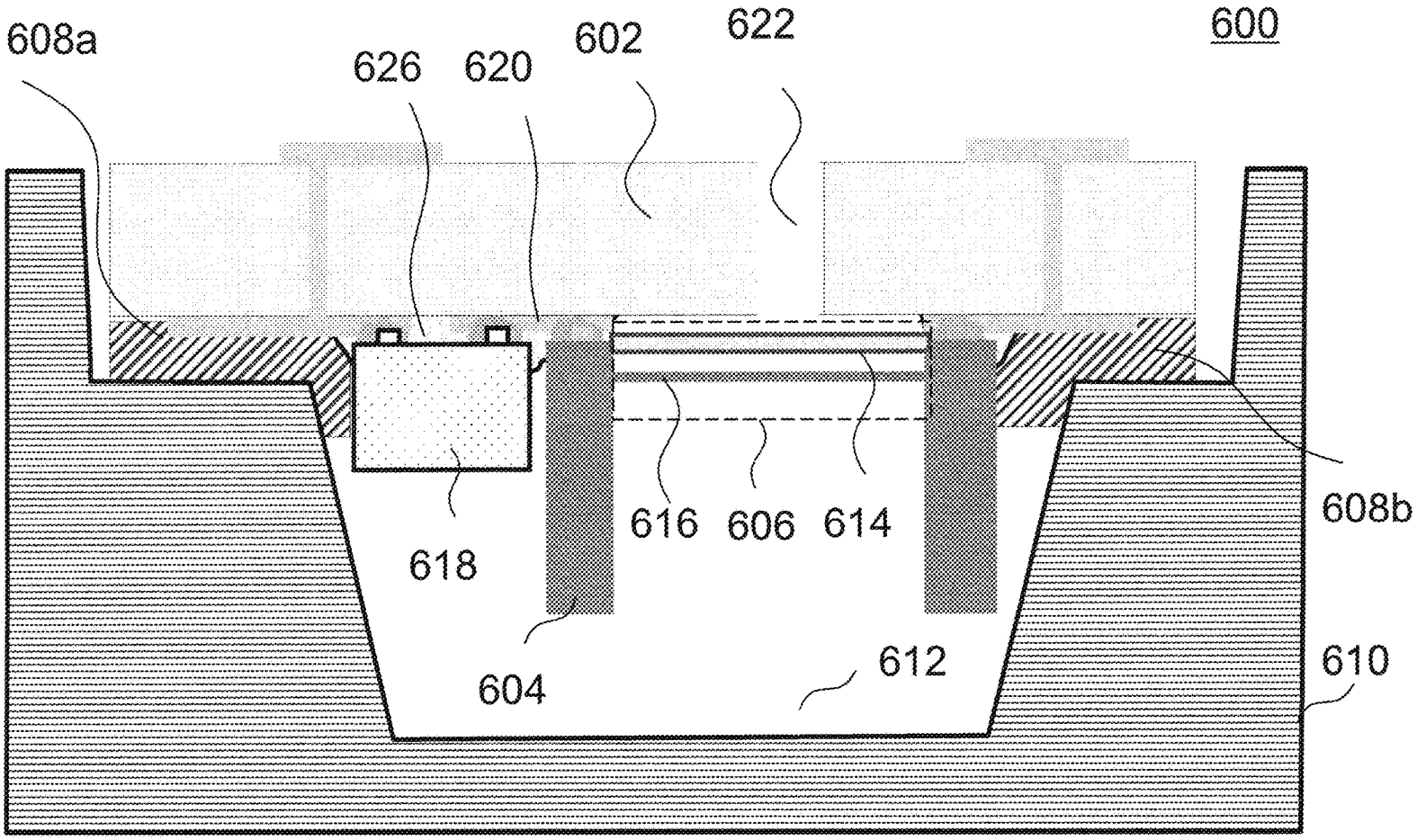
FIG. 6 shows a cross sectional view of a chip arrangement according to various embodiments.

FIG. 6 is a schematic showing a cross sectional view of a chip arrangement 600 according to various embodiments. FIG. 6 shows a chip arrangement 600 including a first carrier 602 and a microphone chip 604 bonded to the first carrier 602 using flip chip bonding. A (e.g. non-conductive) paste 626 may be used to bond the microphone chip 604 with the first carrier 602. The microphone chip 602 includes a microphone structure 606. The microphone structure 606 may include a membrane 614 configured to receive sound waves. The membrane 614 may include at least one electrode. The microphone structure 606 may further include a counter electrode 616. The electrode of the membrane 614 forms a capacitive structure with the counter electrode 616. The microphone structure 606 may include a through via. The membrane 614 and the counter electrode 616 are suspended across the through via. FIG. 6 also shows a further chip 618 bonded to the first carrier 602. The (e.g. non-conductive) paste 626 may also be used to bond the further chip with the first carrier 602. The further chip 618 may be electrically coupled to the microphone chip 604 via electrical interconnects 620 provided on the first carrier 602. The chip arrangement 600 further includes adhesive material 608*a*, 608*b* such as hot melting material laterally disposed from the microphone structure 606. The chip arrangement 600 may further include a second carrier 610 including a cavity 612, wherein the microphone structure 606 is arranged in the cavity 612 of the second carrier 610 such that the adhesive material 608 fixes the microphone chip 604 to the cavity 612 of the second carrier 610. The adhesive material 608*a*, 608*b* joins the first carrier 602 to the second carrier 610. In this manner, the adhesive material 608*a*, 608*b* forms an acoustic seal between the first carrier 602 and the second carrier 610. In various embodiments, a through via 622 on the first carrier 602 may allow the sound waves to reach the membrane 614.

Figure 7:
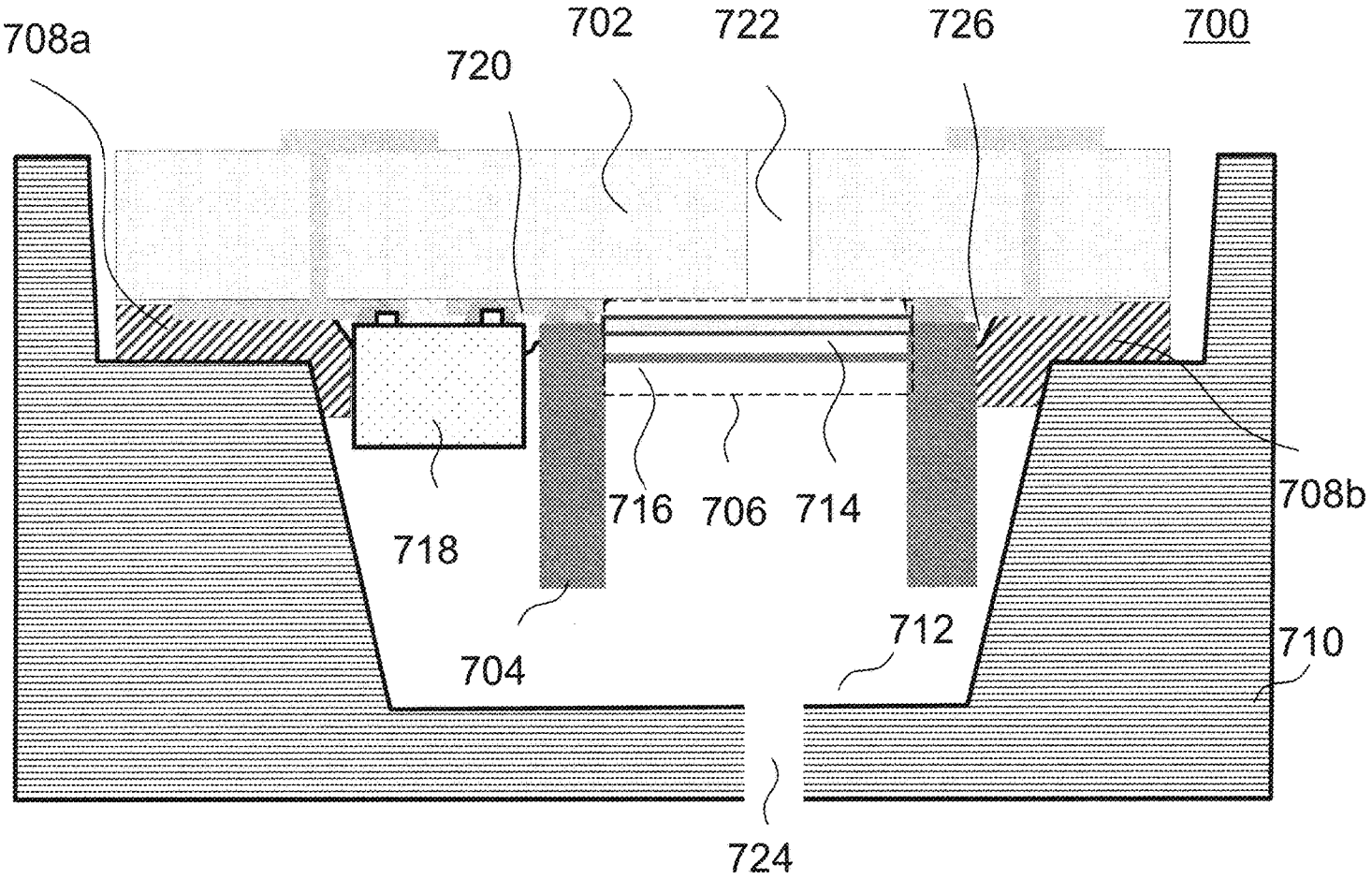
FIG. 7 shows a cross sectional view of a chip arrangement according to various embodiments.

FIG. 7 is a schematic showing a cross sectional view of a chip arrangement 700 according to various embodiments. FIG. 7 shows a chip arrangement 700 including a first carrier 702 and a microphone chip 704 bonded to the first carrier 702 using flip chip bonding. A (e.g. non conductive) paste 726 may be used to bond the microphone chip 704 to the first carrier 702. The microphone chip 702 includes a microphone structure 706. The microphone structure 706 may include a membrane 714 configured to receive sound waves. The membrane 714 may include at least one electrode. The microphone structure 706 may further include a counter electrode 716. The electrode of the membrane 714 may form a capacitive structure with the counter electrode 716. The microphone structure 706 may include a through via. The membrane 714 and the counter electrode 716 are suspended across the through via. FIG. 7 also shows a further chip 718 bonded to the first carrier 702. The further chip 718 may be electrically coupled to the microphone chip 704 via electrical interconnects 720 on the first carrier 702. The (e.g. non conductive) paste 726 may also be used to bond the further chip with the first carrier 702. The chip arrangement 700 may further include adhesive material 708*a*, 708*b* such as hot melting material laterally disposed from the microphone structure 706. The chip arrangement 700 may further include a second carrier 710 including a cavity 712, wherein the microphone structure 706 is arranged in the cavity 712 of the second carrier 710 such that the adhesive material 708 fixes the microphone chip 704 to the cavity 712 of the second carrier 710. The adhesive material 708*a*, 708*b* joins (or fixes) the first carrier 702 to the second carrier 710. In this manner, the adhesive material 708*a*, 708*b* forms an acoustic seal between the first carrier 702 and the second carrier 710. In various embodiments, a through via 724 on the second carrier 710 may allow the sound waves to reach the membrane 714.

Figure 8:
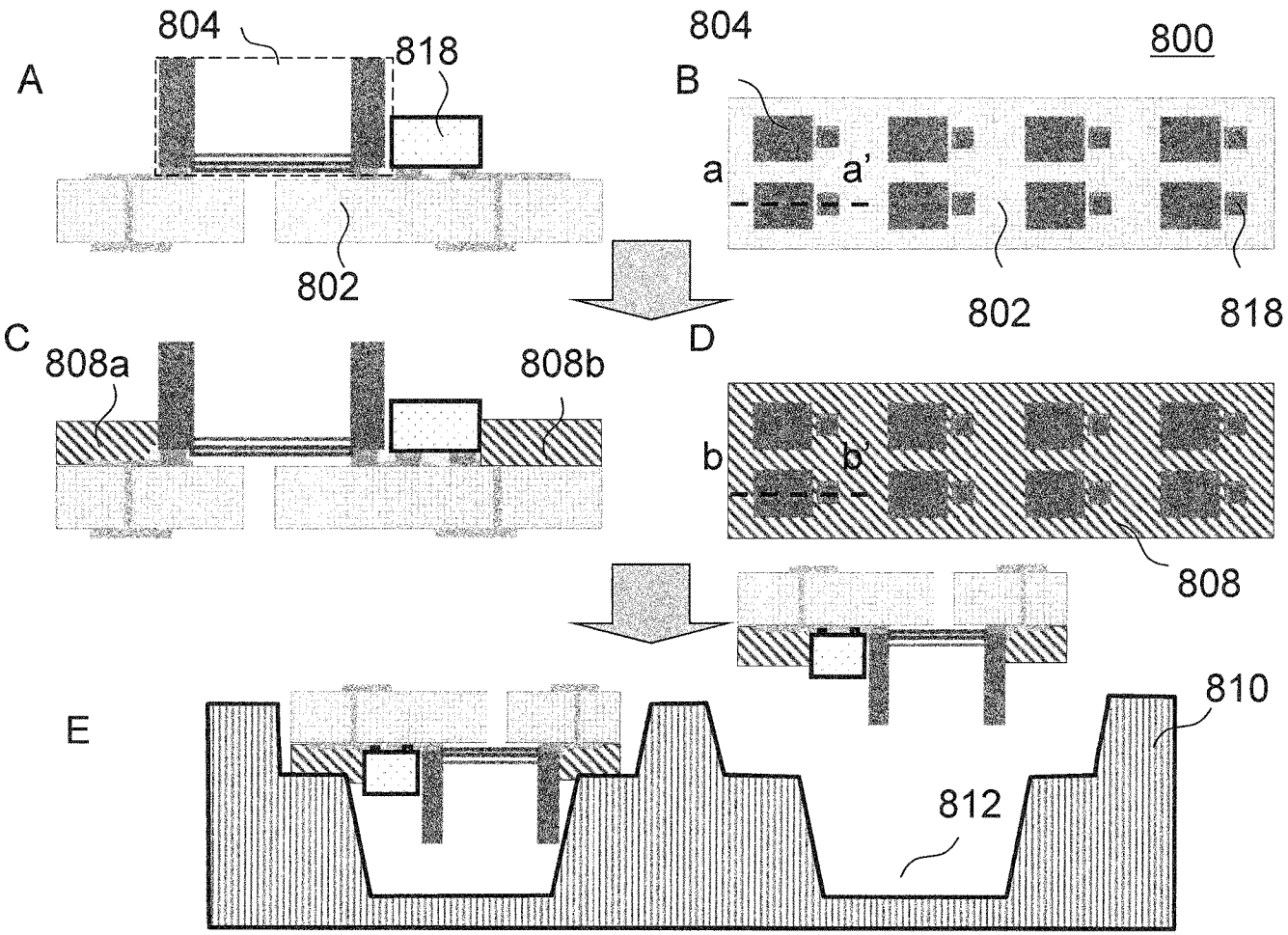
FIG. 8, which includes

FIG. 8 is a schematic illustrating a method 800 to manufacture a chip arrangement according to various embodiments. FIG. 8A is a schematic showing a cross-sectional side view of a module including a microphone chip and a further chip according to various embodiments before adhesive material is deposited. FIG. 8B is a schematic showing a top planar view of a plurality of modules on a first carrier according to various embodiments before adhesive material is applied. The dotted lines aa' in FIG. 8B correspond to the schematic of the cross-sectional side view shown in FIG. 8A. FIG. 8C is a schematic showing a cross-sectional side view of the module including a microphone chip and a further chip according to various embodiments shown in FIG. 8A after adhesive material is deposited. FIG. 8D is a schematic showing a top planar view of the modules on the carrier according to various embodiments shown in FIG. 8B after adhesive material is applied. FIG. 8E is a schematic showing a cross sectional side view of a first chip module and a second chip module according to various embodiments shown in FIG. 8C being arranged with a second carrier. First a microphone chip 804 and a further chip 818 may be bonded to a first carrier 802. As shown in FIG. 8B, a plurality of microphone chips 804 and a plurality of further chips 818 may be bonded to a single carrier 802. An adhesive material 808 such as hot melting material may then be applied. FIG. 8D is a schematic showing a top planar view of the plurality of chip arrangements on the carrier according to various embodiments shown in FIG. 8B after adhesive material 808 has been applied. The dotted lines bb' in FIG. 8D correspond to the schematic of the cross-sectional view shown in FIG. 8C. The modules may each be arranged with the second carrier 810 such that the microphone structure of each microphone chip 804 is arranged into a cavity 812 of the second carrier 810. The first carrier 802 may be pressed into the cavity of the second carrier 810 at a temperature of about 200° C. and a pressure force of 100 N. This may allow the adhesive material 808 to form an acoustic seal between the first carrier 802 and the second carrier 810. A conductive layer may be deposited in the second cavity before the first carrier 802 is pressed into the cavity of the second carrier 810. The plurality of chip arrangements may then be separated, for instance, using singularisation such as die cutting or sawing. The adhesive material 808 may be configured to be easily separated by singularisation. The adhesive material may be configured to be die cuttable or easily sawn. Pressing may be carried out before sigularization.

Figure 9:
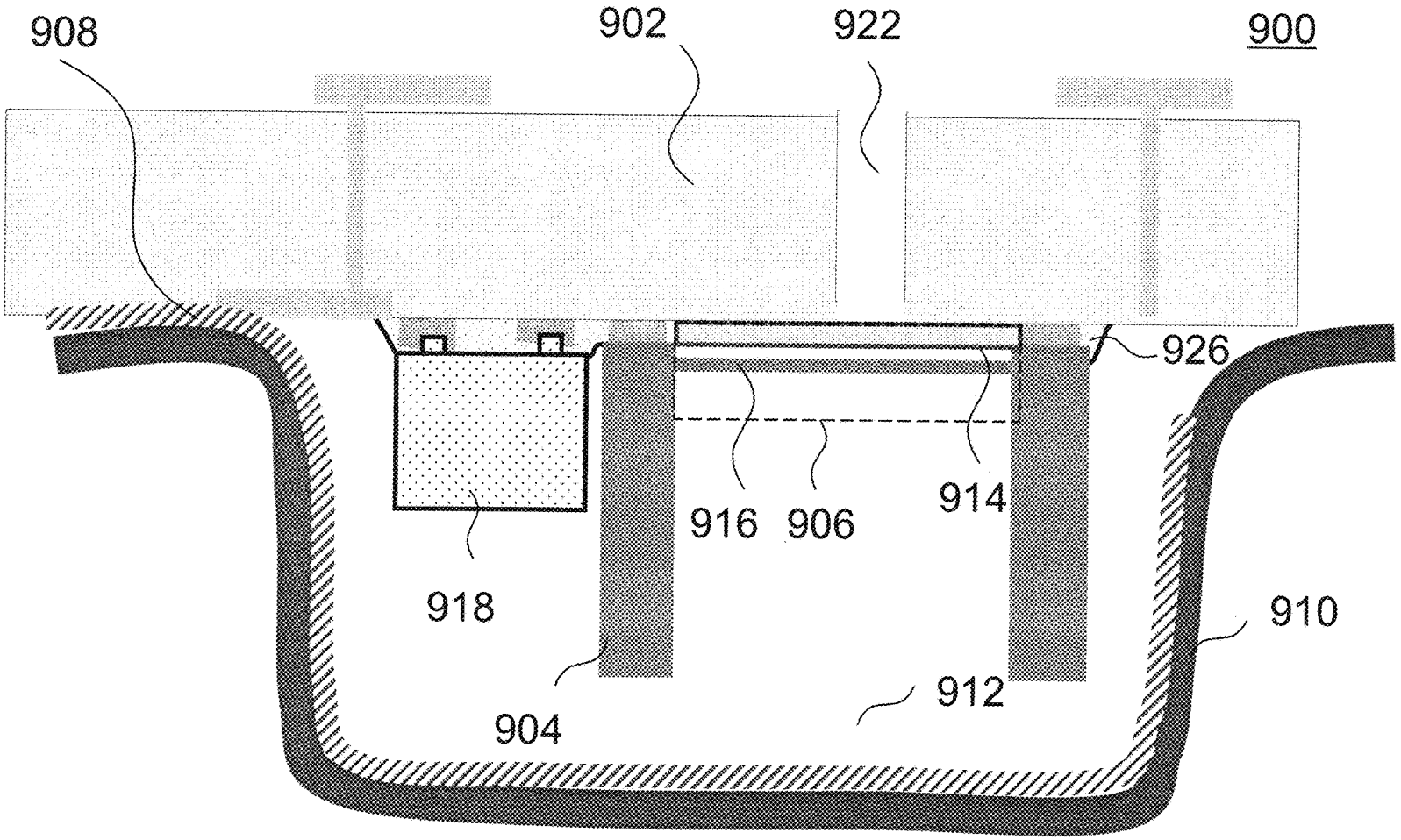
FIG. 9 shows a cross sectional view of a chip arrangement according to various embodiments.

FIG. 9 shows is a schematic showing a cross sectional view of a chip arrangement 900 according to various embodiments. FIG. 9 shows a chip arrangement 900 including a first carrier 902 and a microphone chip 904 bonded to the first carrier 902 using flip chip bonding. A non conductive paste 926 may be used to bond the microphone chip 904 with the first carrier 902. The microphone chip 902 includes a microphone structure 906. The microphone structure 906 may include of a membrane 914 configured to receive sound waves. The membrane 914 may include at least one electrode. The microphone structure 906 may further include a counter electrode 916. The electrode of the membrane 914 forms a capacitive structure with the counter electrode 916. The microphone structure 906 may include a through via. The membrane 914 and the counter electrode 916 are suspended across the through via. FIG. 9 also shows a further chip 918 bonded to the first carrier 902. The non conductive paste 926 may also be used to bond the further chip with the first carrier 902. The chip arrangement 900 may further include a second carrier 910 including a cavity 912, wherein the microphone structure 906 is arranged in the cavity 912 of the second carrier 910 such that the adhesive material 908 fixes the microphone chip 904 to the cavity 912 of the second carrier 910. The second carrier 910 may include a thermoformable plastic. A layer of conductive material 908 may be provided on one side of the second carrier 910. In various embodiments, the conductive material 908 may be the adhesive material. In other words, the conductive material 908 may act as a conductive glue. In various embodiments, the conductive material 908 may act as a shield. In various embodiments, a through via 922 on the first carrier 902 may allow the sound waves to reach the membrane 914.

Figure 10:
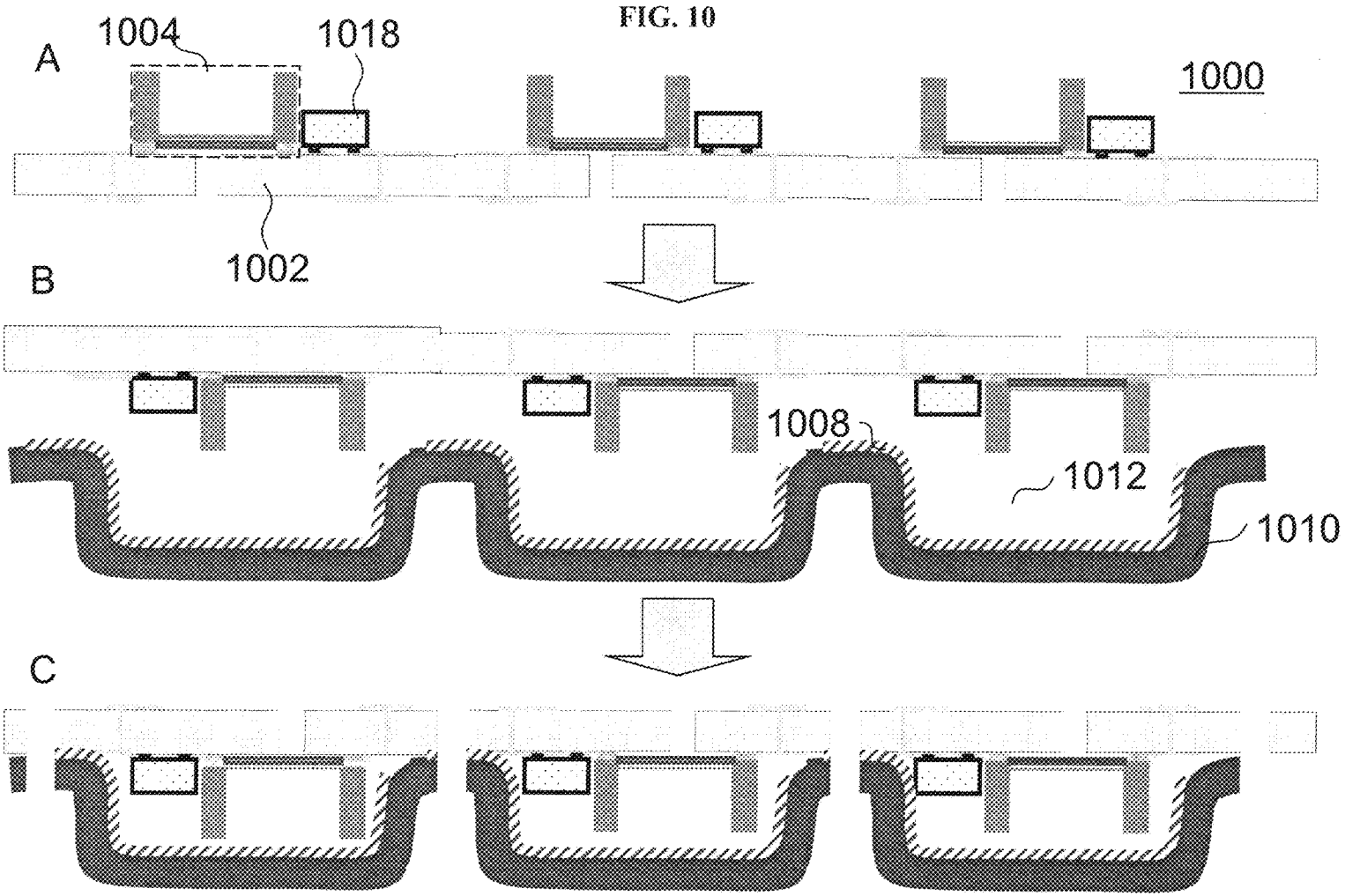
FIG. 10, which includes

FIG. 10 is a schematic illustrating a method 1000 to manufacture a chip arrangement according to various embodiments. FIG. 10A is a schematic showing a cross-sectional side view of a plurality of modules, each module including a microphone chip and a further chip, on a first carrier according to various embodiments. FIG. 10B is a schematic showing a second carrier with a conductive metal on one side of the second carrier. The second carrier has a plurality of cavities. FIG. 10C shows the first carrier and the second carrier being brought together and singulated to form a plurality of chip arrangements. As shown in FIG. 10A, a plurality of microphone chips 1004 and a plurality of further chips 1018 may be bonded to a first carrier 1012. The second carrier 1010 shown in FIG. 10B may include a thermoformable plastic. A conductive material 1008 such as a metal may be deposited or attached to the second carrier 1010. In various embodiments, the conductive material 1008 may be plated onto the second carrier 1010. The first carrier 1012 is flipped and the first carrier 1012 and the second carrier 1010 are brought together. In various embodiments, the first carrier and the second carrier are laminated together. In various embodiments, the conductive material 908 may be the adhesive material. In various embodiments, the microphone structure is arranged into the cavity of the second carrier so that the adhesive material 1008 forms an acoustic seal between the first carrier 1012 and the second carrier 1010. After the first carrier and the second carrier being brought together, singularization is carried out to form a plurality of chip arrangements as shown in FIG. 10C.

For illustration purposes only and not as a limiting example, the term "substantially" may be quantified as a variance of +/−5% from the exact or actual. For example, the phrase "A is (at least) substantially the same as B" may encompass embodiments where A is exactly the same as B, or where A may be within a variance of +/−5%, for example of a value, of B, or vice versa.

In the context of various embodiments, the term "about" as applied to a numeric value encompasses the exact value and a variance of +/−5% of the value.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for manufacturing a chip arrangement, the method comprising:

bonding a microphone chip to a first carrier, the microphone chip comprising a microphone structure;

depositing a conductive adhesive material substantially along the entirety of a second carrier and a cavity of the second carrier; and arranging the first carrier over the second carrier to where the microphone chip is arranged into the cavity of the second carrier such that the conductive adhesive material couples the first carrier to the second carrier, and wherein the microphone chip is disposed on a side of the first carrier facing the second carrier; and arranging a second chip into the cavity of the second carrier, and wherein the second chip is disposed on the side of the first carrier facing the second carrier.

2. The method of claim 1, further comprising:

wherein the second chip is electrically coupled to the microphone chip.

3. The method of claim 1, wherein the second chip is electrically coupled to the microphone chip via the first carrier.

4. The method of claim 1, wherein the second chip is electrically coupled to the microphone chip via wire bonds.

5. The method of claim 1, wherein the second chip comprises a logic chip.

6. The method of claim 1, wherein the second chip comprises an application specific integrated circuit chip.

7. The method of claim 1,
wherein the second chip is configured to carry out signal processing of one or more signals received from the microphone chip.

8. The method of claim 1,
wherein the microphone structure comprises at least one membrane configured to receive sound waves.

9. The method of claim 1,
wherein the conductive adhesive material is a thermoplastic adhesive material.

10. The method of claim 1,
wherein the microphone structure is arranged into the cavity of the second carrier where the conductive adhesive material forms an acoustic seal between the first carrier and the second carrier.

11. The method of claim 1,
wherein the conductive adhesive material is deposited after the microphone chip has been bonded to the first carrier.

12. The method of claim 1,
wherein the arranging the microphone structure into the cavity of the second carrier comprises pressing the first carrier into the cavity of the second carrier.

13. The method of claim 12,
wherein the pressing is carried out using a pressure force in the range from about 50 N to about 150 N, at a temperature in the range from about 150° C. to about 250° C.

14. A chip arrangement, comprising:
a first carrier;
a microphone chip bonded to the first carrier, the microphone chip comprising a microphone structure; wherein the first carrier is disposed over the microphone chip;
a conductive adhesive material disposed substantially along the entirety of a cavity of a second carrier and a cavity of the second carrier; and
a second chip bonded to the first carrier; wherein the first carrier is disposed over the second chip; and
wherein the microphone chip is arranged in the cavity of the second carrier such that the conductive adhesive material couples the first carrier to the second carrier, and wherein the microphone chip and the second chip are disposed on a side of the first carrier facing the second carrier.

15. The chip arrangement of claim 14,
wherein the microphone chip is bonded to the first carrier via a flip chip bonding.

16. The chip arrangement of claim 14, further comprising:
wherein the second chip is electrically coupled to the microphone chip.

17. The chip arrangement of claim 16,
wherein the second chip is electrically coupled to the microphone chip via the first carrier.

18. The chip arrangement of claim 14,
wherein the second chip is electrically coupled to the microphone chip via wire bonds.

19. The chip arrangement of claim 14,
wherein the second chip comprises a logic chip.

20. The chip arrangement of claim 14,
wherein the second chip is configured to carry out signal processing of one or more signals received from the microphone chip.

21. The chip arrangement of claim 14,
wherein the microphone structure comprises at least one membrane configured to receive sound waves.

22. The chip arrangement of claim 14,
wherein the conductive adhesive material is a thermoplastic adhesive material.

23. The chip arrangement of claim 14,
wherein the conductive adhesive material is disposed with a layer thickness in the range from about 30 μm to about 150 μm.

24. The chip arrangement of claim 14,
wherein the microphone structure is arranged into the cavity of the second carrier so that the conductive adhesive material form an acoustic seal between the first carrier and the second carrier.

* * * * *